US005927886A

United States Patent [19]

Matsumoto

[11] Patent Number: 5,927,886

[45] Date of Patent: Jul. 27, 1999

[54] DIRECT INK STORAGING TYPE WRITING IMPLEMENT

[75] Inventor: Kazuaki Matsumoto, Yokohama, Japan

[73] Assignee: Mitsubishi Pencil Kabushiki Kaisha, Tokyo, Japan

[21] Appl. No.: 08/973,834

[22] PCT Filed: Dec. 24, 1996

[86] PCT No.: PCT/JP96/03750

§ 371 Date: Dec. 18, 1997

§ 102(e) Date: Dec. 18, 1997

[87] PCT Pub. No.: WO97/30854

PCT Pub. Date: Aug. 28, 1997

[30] Foreign Application Priority Data

Feb. 20, 1996 [JP] Japan ..... 8-055343

[51] Int. Cl.[6] ..... B43K 8/06; B43K 7/08; B43K 5/18

[52] U.S. Cl. ..... 401/199; 401/209; 401/225; 401/227; 401/228

[58] Field of Search ..... 401/198, 199, 401/209, 225, 227, 228, 229, 258

[56] References Cited

U.S. PATENT DOCUMENTS

| | | | |
|---|---|---|---|
| 3,951,555 | 4/1976 | Wittnebert et al. | 401/199 X |
| 4,968,169 | 11/1990 | Yokosuka et al. | 402/227 |

FOREIGN PATENT DOCUMENTS

| | | | |
|---|---|---|---|
| 2-58979 | 4/1990 | Japan . | |
| 4-5986 | 1/1992 | Japan . | |
| 4-60486 | 5/1992 | Japan . | |
| 632093 | 2/1994 | Japan | 401/209 |

*Primary Examiner*—Steven A. Bratlie
*Attorney, Agent, or Firm*—Darby & Darby

[57] ABSTRACT

A longitudinal groove which allows a number of annular grooves formed on the outer peripheral surface of an ink storage body to communicate with an ink chamber is cut halfway into the thickness of a flange formed at the rear part of the ink storage body. An outer part of the longitudinal groove cut into the flange is made to communicate with a passage which is defined by a cutout formed on the periphery of the flange and the inner wall of the barrel cylinder so that this passage establishes communication between the longitudinal groove and the ink chamber.

2 Claims, 7 Drawing Sheets

DIRECT INK STORAGING TYPE WRITING IMPLEMENT

TECHNICAL FILED

The present invention relates to an ink direct-storage type writing implement having an ink chamber which directly stores ink without making a filler or the like absorb ink, wherein an ink storage body which temporarily stores ink is provided in order to prevent ink from being pushed out from the ink chamber and blotting from the writing point, or from the vent when the air inside the ink chamber expands due to a temperature rise, etc.

BACKGROUND ART

In conventional ink direct-storage type writing implements, a longitudinal groove which establishes the communication between annular storage grooves as the ink storage body and the ink chamber is bored directly from the storage grooves to the ink chamber through the flange so that the ink pushed out from the ink chamber is conducted through the longitudinal groove and stored in the storage grooves. This longitudinal groove also serves as an air replacing groove, admitting air into the ink chamber through itself within the flange when the pressure in the ink chamber reduces as ink is consumed.

With the conventional ink storage body incorporated in the barrel cylinder, the flange at the rear of the ink storage body closely fits the inner wall of the barrel cylinder so that no clearance will be formed on the outer peripheral surface of the flange except at the longitudinal groove. For this purpose, the variations in the inside diameter dimension of the barrel cylinder and the deformation of the shape thereof as well as the variations in the outside diameter dimension of the flange and the deformation of the shape thereof are taken into account. That is, the flange of the ink storage body is squeezed into the barrel cylinder so that the flange and the inner wall of the barrel cylinder change in shape to closely fit to one another absorbing the variations in the size and the deformation of the shapes. Thus, the flange and the inner wall of the barrel cylinder will not leave any gap therebetween.

In the above configuration, however, when the flange of the ink storage body is squeezed and fitted into the barrel cylinder, the storage body is inwardly stressed so that the flange changes in shape in such a way that the longitudinal groove becomes narrowed since the flange is slotted to half its radius because of the longitudinal groove. For this reason, the width of the longitudinal groove will not be constant because of the variations in the inner diameter dimension and deformation of the barrel cylinder and the variations in the outside diameter dimension and deformation of the flange.

The longitudinal groove has the function of conducting the ink pushed out from the ink chamber to the storage grooves for storing it, and the air replacing function of admitting air into the ink chamber through itself within the flange when the pressure in the ink chamber reduces as ink is consumed. Therefore, in the case where the width of the longitudinal groove is too narrow, if air in the ink chamber expands due to a temperature rise, etc., it disturbs the flow of the ink which should be pushed out from the ink chamber to the storage grooves, at the narrowed longitudinal groove in the flange, possibly causing accidental ink leakage from the writing point. Or, when the pressure in the ink chamber reduces with the consumption of ink, air must enter through the longitudinal groove in the flange, but the narrow width of the longitudinal groove makes it difficult for air to enter. In this case, the pressure in the ink chamber is hard to restore and remains low, causing a bad writing sensation with poor ink flow from the writing point, or causing ink starving during drawing lines.

DISCLOSURE OF THE INVENTION

It is therefore an object of the present invention to provide an ink direct-storage type writing implement which can prevent ink leakage from its writing point or ink starving during drawing lines.

In accordance with an ink direct-storage type writing implement of the invention devised to attain the above object, a longitudinal groove in an ink storage body extends up to a flange formed at the rear part of the ink storage body in such an arrangement that the groove does not penetrate through the rear end surface of the flange but stops halfway therethrough and so that an outer part of the longitudinal groove cut into the flange is connected to a passage which is defined by a cutout formed across a part of the periphery of the flange and the inner wall of the barrel cylinder and opens toward the ink chamber so as to make the longitudinal groove communicate with the ink chamber. This configuration prevents the longitudinal groove from becoming narrowed when the flange is squeezed and fitted into the barrel cylinder.

In accordance with an aspect of the invention, an ink direct-storage type writing implement comprises: a barrel cylinder having an ink chamber formed at the rear part thereof to directly store ink; an ink storage body, which is fitted inside at the front part of the barrel cylinder, having a plurality of annular grooves formed on outer peripheral surface thereof, a longitudinal groove axially formed to make the annular grooves communicate with one another, a flange formed at the rear part thereof, and an axial hollow penetrating through the approximate center thereof; and an ink feed inserted into the axial hollow and having an ink channel at the approximate center thereof to conduct ink from the ink chamber to a writing point, wherein the longitudinal groove in the ink storage body is cut halfway into the thickness of the flange formed at the rear part of the ink storage body, and an outer part of the longitudinal groove cut into the flange is made to communicate with a passage which is defined by a cutout formed on the periphery of the flange and the inner wall of the barrel cylinder and which opens toward the ink chamber so that the passage establishes communication between the longitudinal groove and the ink chamber.

In accordance with another aspect of the invention, an ink direct-storage type writing implement comprises: a barrel cylinder having an ink chamber formed at the rear part thereof to directly store ink; an ink storage body, which is fitted inside at the front part of the barrel cylinder, having a plurality of annular grooves formed on outer peripheral surface therefof, a longitudinal groove axially formed to make the annular grooves communicate with one another, a flange formed at the rear part thereof, and an axial hollow penetrating through the approximate center thereof; and an ink feed inserted into the axial hollow and having an ink channel at the approximate center thereof to conduct ink from the ink chamber to a writing point, wherein the longitudinal groove in the ink storage body is cut halfway into the thickness of the flange formed at the rear part of the ink storage body, an outer part of the longitudinal groove cut into the flange is made to intersect an annular groove formed on the outer periphery of the flange and join thereto, a cutout is formed on the periphery of the flange at the position opposite the intersection between the longitudinal groove and the annular groove of the flange, and a part of the annular groove in the flange is made to communicate with a passage which is defined by the cutout in the flange and the inner wall of the barrel cylinder and which opens toward the ink chamber so that the passage establishes communication between the longitudinal groove and the ink chamber.

In the thus configured ink direct-storage type writing implement, if the flange in the ink storage body is inwardly stressed by squeezing it into the barrel cylinder, the longitudinal groove cut into the flange will hardly be narrowed, thus the flow of ink and air will not be disturbed.

BEST MODE FOR CARRYING OUT THE INVENTION

Figure 1:
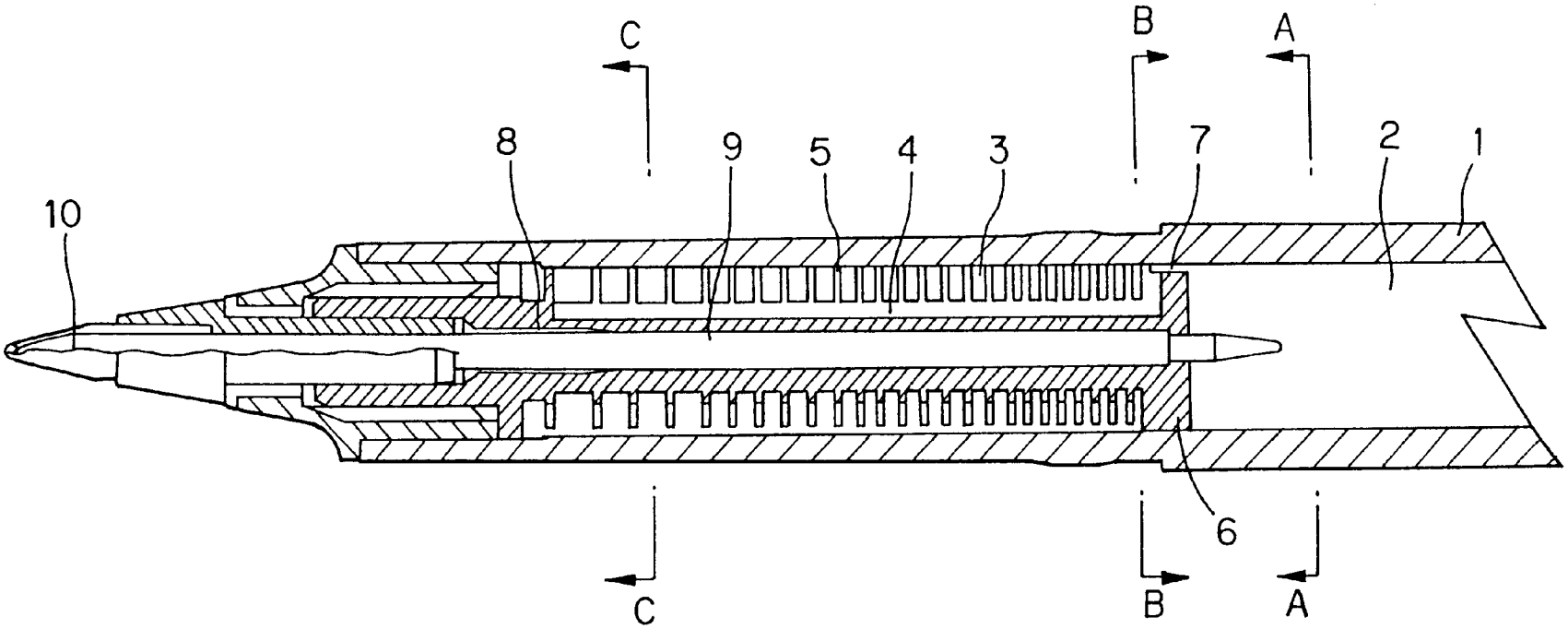
FIG. 1 is a vertical sectional view showing an embodiment of an ink direct-storage type writing implement of the invention.

An embodiment of an ink direct-storage type writing implement of the invention will be detailed with reference to the drawings. FIG. 1 is a vertical sectional view showing an embodiment of an ink direct-storage type writing implement of the invention.

As shown in FIG. 1, the barrel cylinder (designated at 1) in the writing implement body has an ink chamber 2 at the rear part thereof and an ink storage body 5 fitted inside at the front part thereof. The ink chamber 2 directly stores ink. The ink storage body 5 has a longitudinal hollow 8 axially extending through the center thereof. An ink feed 9 is inserted into the longitudinal hollow 8. The ink feed 9 is connected to a writing point 10 fitted in the front part of the ink storage body 5 so that ink in the ink chamber 2 is supplied to the writing point 10.

Figure 2:
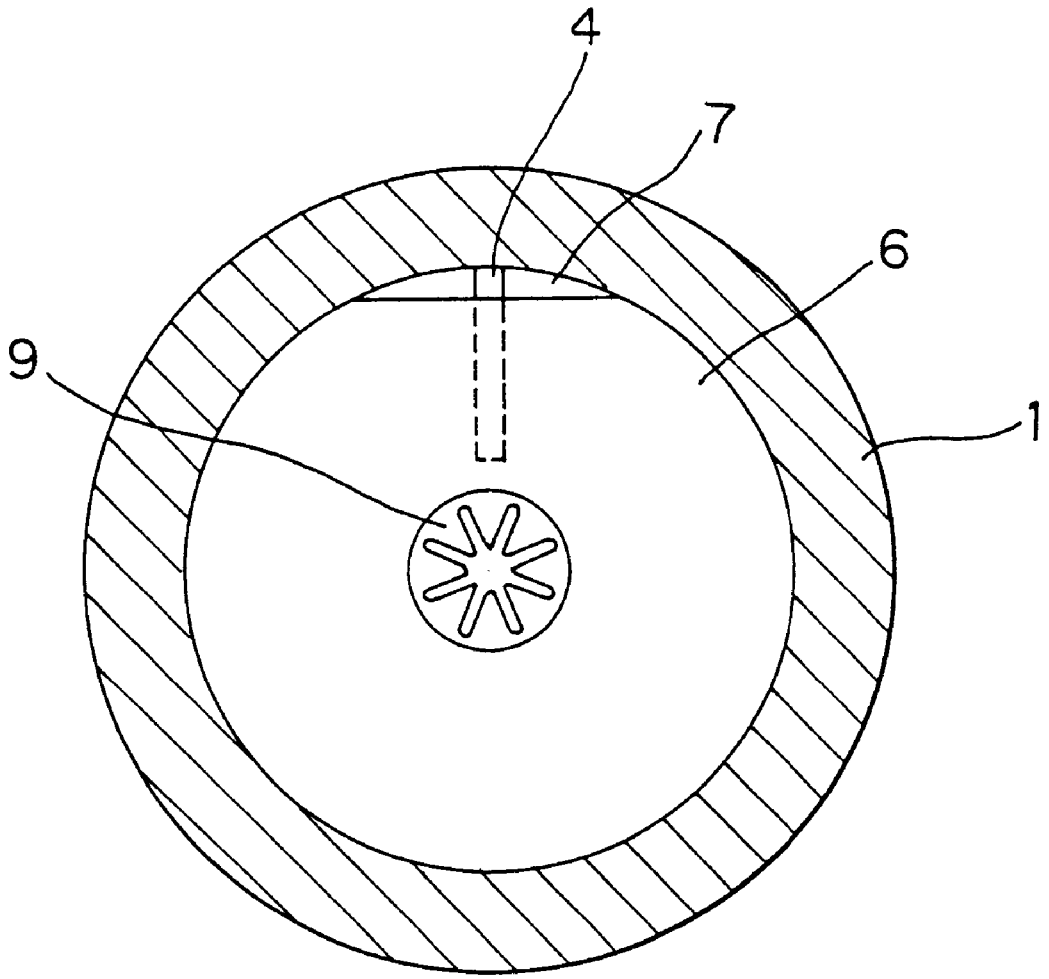
FIG. 2 is a transverse sectional view cut by A—A in FIG. 1.
Figure 3:
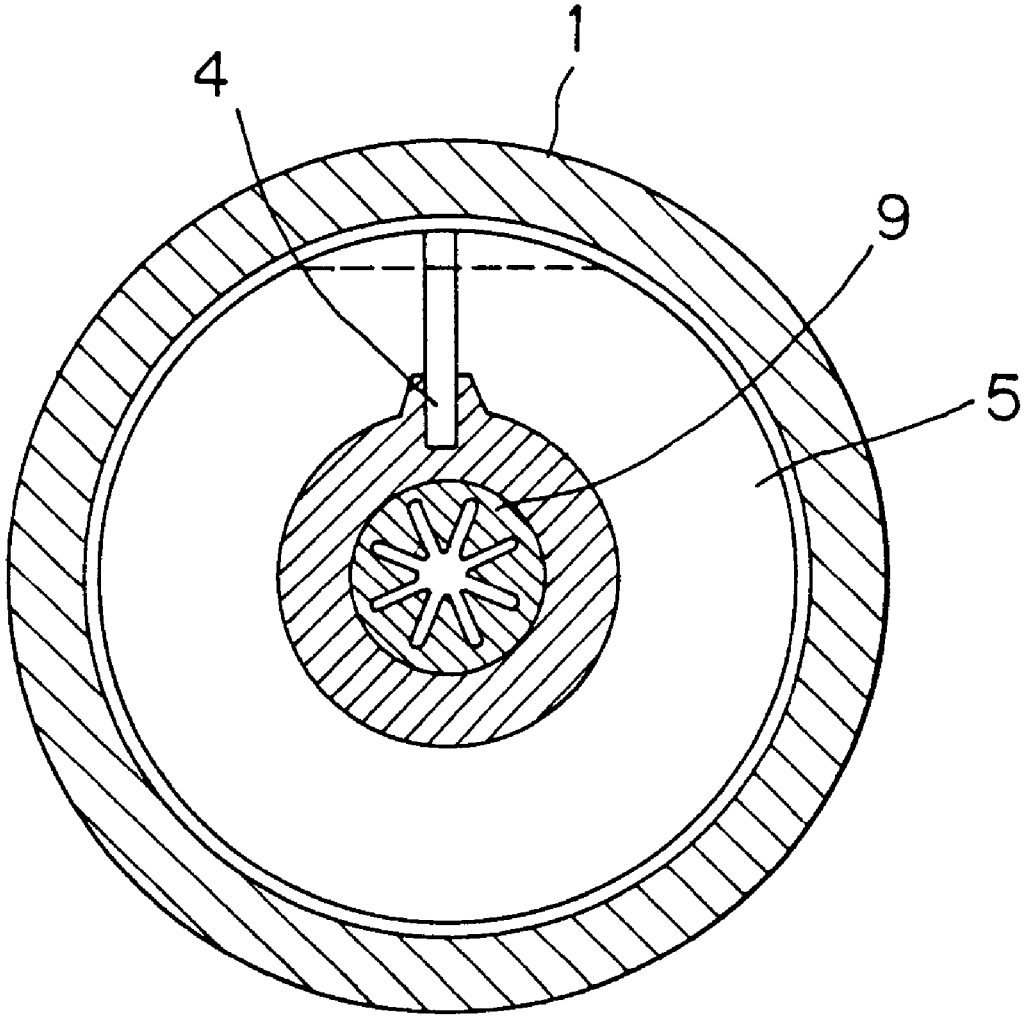
FIG. 3 is a transverse sectional view cut by B—B in FIG. 1.
Figure 4:
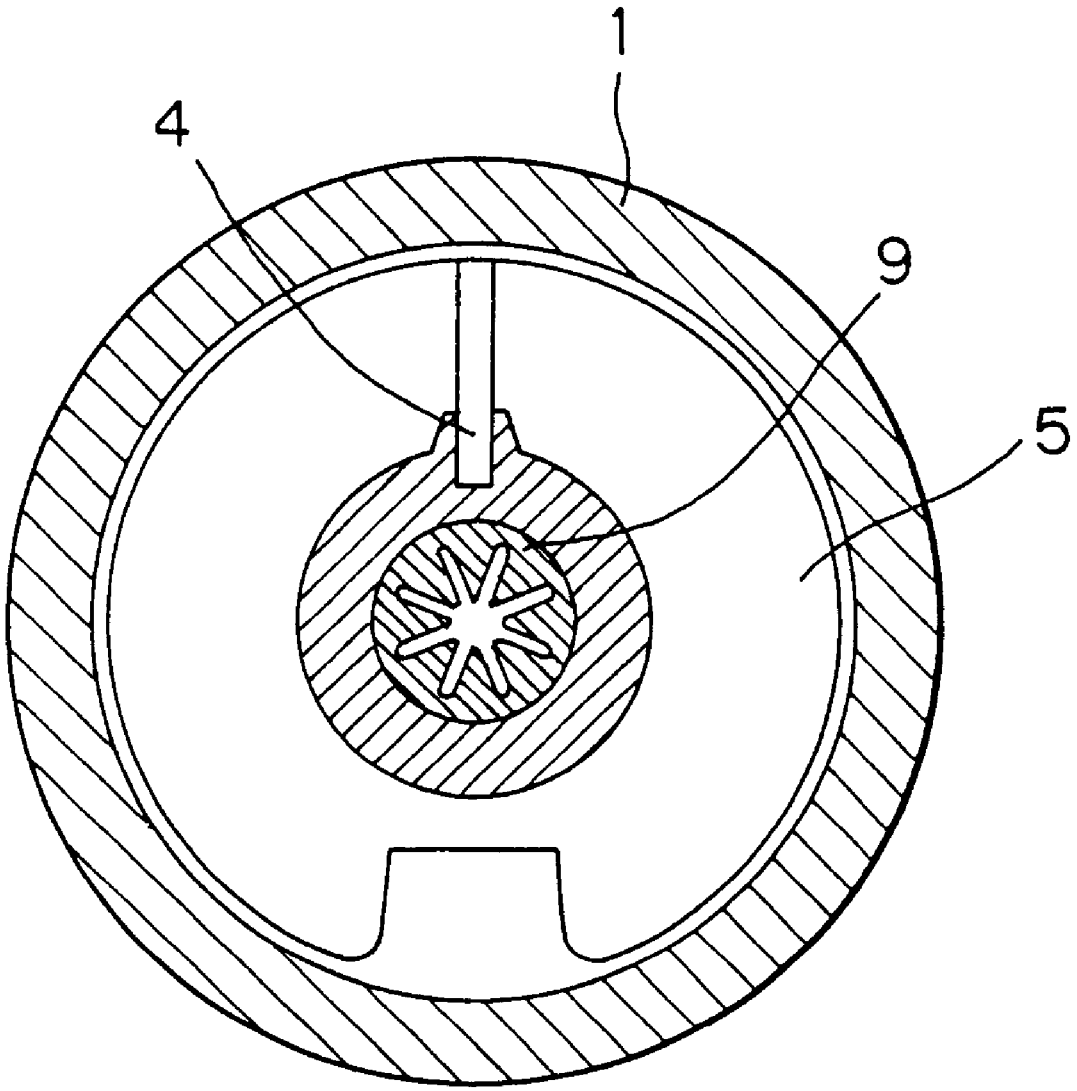
FIG. 4 is 3 is a transverse sectional view cut by C—C in FIG. 1.

Referring next to FIGS. 2–4, the structure of the ink storage body 5 will be described further. The ink storage body 5 has a plurality of annular storage grooves 3 formed on the outer peripheral surface thereof. A longitudinal groove 4 which establishes communication between the multiple storage grooves 3 is formed along the axial direction. This longitudinal groove 4 extends up to a flange 6 formed at the rear part of the ink storage body 5 in such an arrangement that the groove does not penetrate through the rear end surface of the flange 6 but stops halfway therethrough so that an outer part of the longitudinal groove 4 cut into the flange 6 is connected to a cutout 7 formed across a part of the periphery of the flange 6. That is, an outer part of the longitudinal groove 4 is connected to a passage which is defined by the cutout 7 and the inner wall of the barrel cylinder 1 and which opens toward ink chamber 2, so that this passage makes the longitudinal groove 4 communicate with the ink chamber 2.

When thus formed ink storage body 5 is assembled into the barrel cylinder 1, the flange 6 is squeezed and fitted into the small-diametric portion of the barrel cylinder 1 so that the outer peripheral surface of the flange 6 comes in close contact with the inner wall of the small-diametric portion of the barrel 1, with the flange 6 being inwardly stressed. Nevertheless, since the longitudinal groove 4 formed within the flange 6 has a depth of about half the width of the flange 6 and the rear half of the flange 6 only has the small cutout 7 on the periphery thereof, even if stress acts on the longitudinal groove 4 to make it narrower, the rear half of the flange 6 will hardly be deformed inward and tries to expand the barrel cylinder 1. As a result, the front half of the flange 6 is only a little deformed so that the longitudinal groove 4 which is cut into the flange 6 hardly becomes narrowed and is able to keep its groove width as it was before the assembly.

As described above, the longitudinal groove 4 has the function of conducting the ink pushed out from the ink chamber 2 to the storage grooves 3 for storing it, and the air replacing function of admitting air into the ink chamber 2 through itself within the flange 6 when the pressure in the ink chamber 2 reduces as ink is consumed. As to these functions, since the width of the longitudinal groove 4 will not become narrowed when the flange 6 is squeezed and fitted into the barrel cylinder 1, it is possible to prevent accidental ink leakage from the writing point 10, attributed to the narrowed longitudinal groove 4 or occurring when air in the ink chamber 2 expands due to a temperature rise, etc., and disturbs the flow of the ink which should be pushed out from the ink chamber 2 to the storage grooves 3, at the narrowed longitudinal groove 4 in the flange 6. It is also possible to eliminate the problem of uncomfortable writing sensation with poor ink flow from the writing point 10 and ink starvation during line drawing, which is also attributed to the narrowed longitudinal groove 4, or would occur when the pressure in the ink chamber 2 reduces with the consumption of ink and remains low because of difficulty of restoration of pressure due to difficulty in air entering through the narrowed longitudinal groove 4 in the flange 6.

Figure 5:
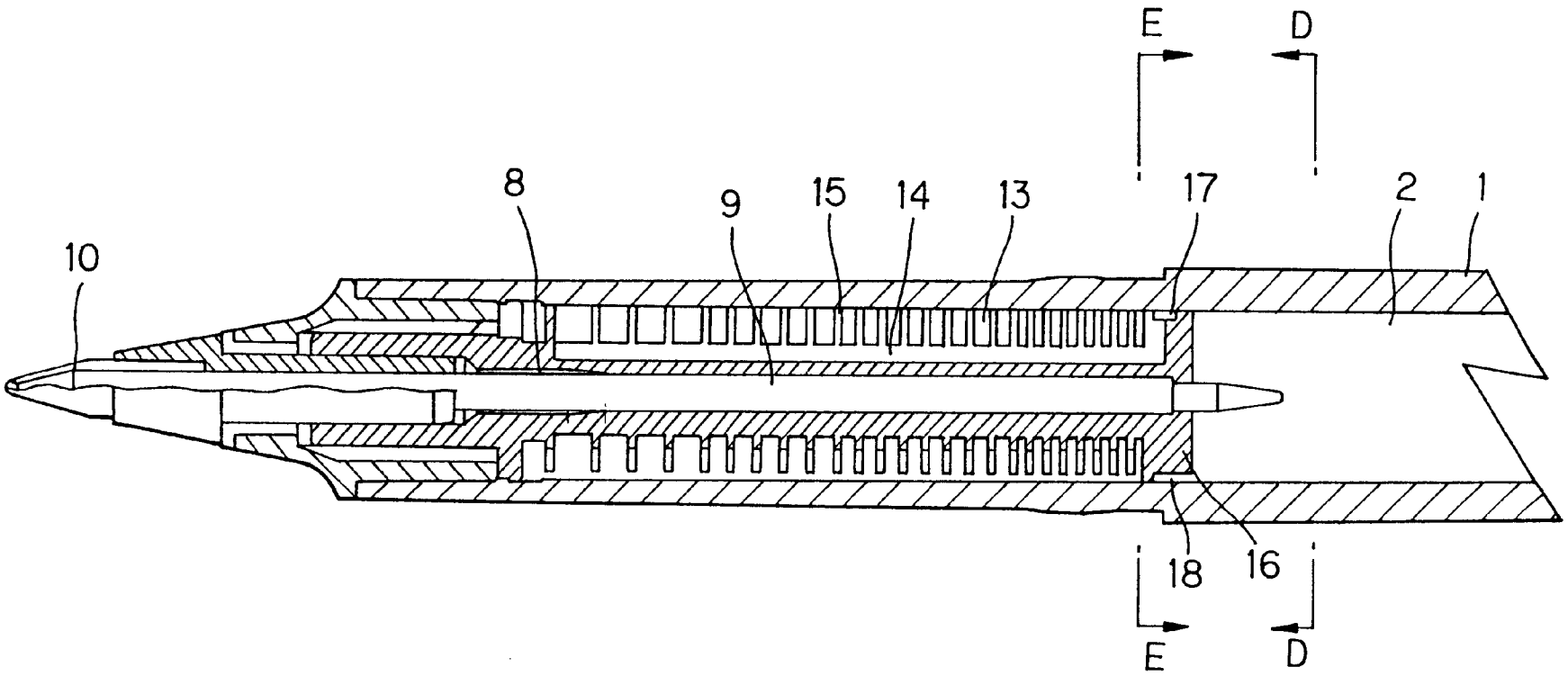
FIG. 5 is a vertical sectional view showing another embodiment of an ink direct-storage type writing implement of the invention.
Figure 6:
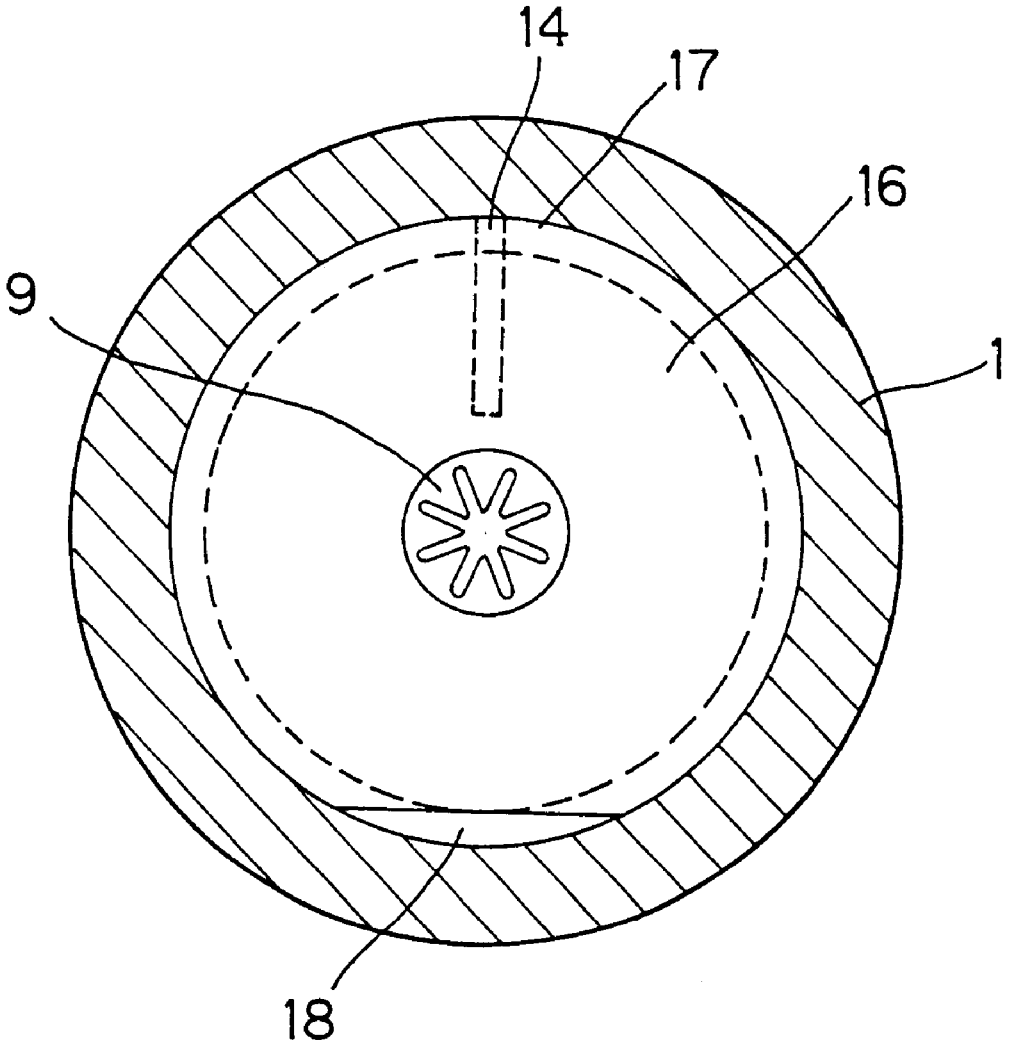
FIG. 6 is a transverse sectional view cut by D—D in FIG. 5.
Figure 7:
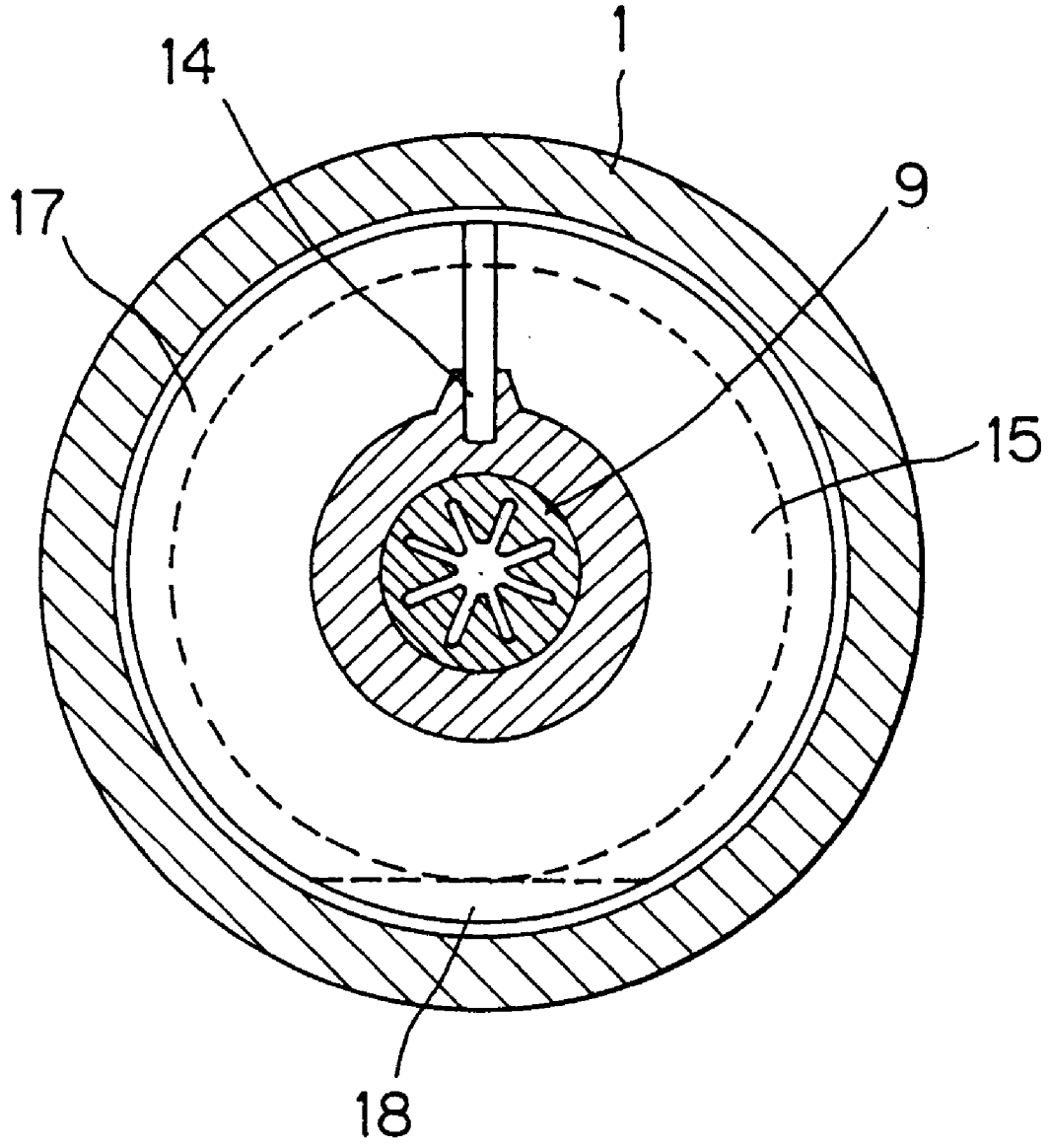
FIG. 7 is a transverse sectional view cut by E—E in FIG. 5.

FIG. 5 is a vertical sectional view showing another embodiment of an ink direct-storage type writing implement of the invention; FIG. 6 is a transverse sectional view cut by D—D in FIG. 5; and FIG. 7 is a transverse sectional view cut by E—E in FIG. 5. In this embodiment, the same reference numerals are allotted to the same components as those used in the foregoing embodiment and the description will not be repeated.

As shown in FIGS.5—7, an ink storage body 15 in this embodiment has many annular storage grooves 13 formed on the outer peripheral surface thereof. A longitudinal groove 14 which establishes communication between storage grooves 13 is formed in the ink storage body 15 along the axial direction. This longitudinal groove 14 extends up to a flange 16 formed at the rear part of the ink storage body 15 in such an arrangement that it does not penetrate through the rear end surface of the flange 16 but stops halfway therethrough. The flange 16 has an annular groove 17 which intersects the longitudinal groove 14 and joins to it. A cutout 18 is formed on the flange 16 at the position opposite the intersection between the annular groove 17 and the longitudinal groove 14. As a result, the cutout 18 establishes communication between the longitudinal groove 14 and the ink chamber 2 via the annular groove 17.

When thus formed ink storage body 15 is assembled into the barrel cylinder 1, the flange 16 is squeezed and fitted into the small-diametric portion of the barrel cylinder 1 so that the outer peripheral surface of the flange 16 comes in close contact with the inner wall of the small-diametric portion of the barrel cylinder 1, with flange 16 being inwardly stressed. Nevertheless, since the longitudinal groove 14 formed within the flange 16 is cut only halfway in the axial direction and since the flange 16 only has the cutout 18 at the position opposite the intersection between the longitudinal groove 14 and the annular groove 17, even if stress acts on the longitudinal groove 14 to make it narrower, the rear half of the flange 16 will hardly be deformed inward because no cutout exists near the longitudinal groove 14 in the rear half of the flange 16. As a result, the front half of the flange 16 is only a little deformed so that the longitudinal groove 14 which is cut into the flange 16 hardly becomes narrowed and tries to expand the barrel cylinder 1 and is able to keep its groove width as it was before assembly.

Accordingly, since the longitudinal groove 14 cut into the flange 16 will hardly become narrowed when the ink storage body 15 is squeezed and fitted into the barrel cylinder 1 and the flange 16 is inwardly stressed, ink can smoothly flow from the cutout 18 to the longitudinal groove 14 through the annular groove 17 while air can advance from the longitudinal groove 14 to the cutout 18 through the annular groove 17 to finally, smoothly enter the ink chamber 2. As apparent from the above description, this configuration will not inhibit the flow of ink and air.

I claim:

1. An ink direct-storage type writing implement, comprising:

a barrel cylinder having an ink chamber formed at the rear part thereof to directly store ink;

an ink storage body, which is fitted inside at the front part of the barrel cylinder, having a plurality of annular grooves formed on outer peripheral surface thereof, a longitudinal groove axially formed to make the annular grooves communicate with one another, a flange formed at the rear part thereof, and an axial hollow penetrating through the approximate center thereof; and an ink feed inserted into the axial hollow and having an ink channel at the approximate center thereof to conduct ink from the ink chamber to a writing point, wherein the longitudinal groove in the ink storage body is cut halfway into the thickness of the flange formed at the rear part of the ink storage body, and an outer part of the longitudinal groove cut into the flange is made to communicate with a passage which is defined by a cutout formed on the periphery of the flange and the inner wall of the barrel cylinder and which opens toward the ink chamber so that the passage establishes communication between the longitudinal groove and the ink chamber.

2. An ink direct-storage type writing implement, comprising:

a barrel cylinder having an ink chamber formed at the rear part thereof to directly store ink;

an ink storage body, which is fitted inside at the front part of the barrel cylinder, having a plurality of annular grooves formed on outer peripheral surface thereof, a longitudinal groove axially formed to make the annular grooves communicate with one another, a flange formed at the rear part thereof, and an axial hollow penetrating through the approximate center thereof; and an ink feed inserted into the axial hollow and having an ink channel at the approximate center thereof to conduct ink from the ink chamber to a writing point, wherein the longitudinal groove in the ink storage body is cut halfway into the thickness of the flange formed at the rear part of the ink storage body, an outer part of the longitudinal groove cut into the flange is made to intersect an annular groove formed on the outer periphery of the flange and join thereto, a cutout is formed on the periphery of the flange at the position opposite the intersection between the longitudinal groove and the annular groove of the flange, and a part of the annular groove in the flange is made to communicate with a passage which is defined by the cutout in the flange and the inner wall of the barrel cylinder and which opens toward the ink chamber so that the passage establishes communication between the longitudinal groove and the ink chamber.

* * * * *

UNITED STATES PATENT AND TRADEMARK OFFICE

CERTIFICATE OF CORRECTION

PATENT NO. : 5,927,886

DATED : July 27, 1999

INVENTOR(S) : Kazuaki MATSUMOTO

It is certified that error appears in the above-identified patent and that said Letters Patent is hereby corrected as shown below:

ON THE TITLE PAGE:

Item [54] title, delete "DIRECT INK STORAGING TYPE WRITING IMPLEMENT" and insert therefor -- INK DIRECT-STORAGE TYPE WRITING IMPLEMENT --.

Signed and Sealed this

Twenty-second Day of February, 2000

*Attest:*

*Attesting Officer*

Q. TODD DICKINSON

*Commissioner of Patents and Trademarks*